US010816291B1

(12) United States Patent
Silverthorne

(10) Patent No.: US 10,816,291 B1
(45) Date of Patent: Oct. 27, 2020

(54) FIREARM SECURITY DEVICE

(71) Applicant: Vincent Richard Silverthorne, Vancouver, WA (US)

(72) Inventor: Vincent Richard Silverthorne, Vancouver, WA (US)

( * ) Notice: Subject to any disclaimer, the term of this patent is extended or adjusted under 35 U.S.C. 154(b) by 0 days.

(21) Appl. No.: 16/847,609

(22) Filed: Apr. 13, 2020

Related U.S. Application Data

(60) Provisional application No. 62/833,466, filed on Apr. 12, 2019.

(51) Int. Cl.
*F41A 17/02* (2006.01)
*F41A 17/06* (2006.01)
*F41A 17/46* (2006.01)
*F41A 17/54* (2006.01)

(52) U.S. Cl.
CPC ..... *F41A 17/02* (2013.01); *F41A 17/063* (2013.01); *F41A 17/46* (2013.01); *F41A 17/54* (2013.01)

(58) Field of Classification Search
CPC ..... F41A 17/02; F41A 17/06; F41A 17/063; F41A 17/066; F41A 17/46; F41A 17/54
See application file for complete search history.

(56) References Cited

U.S. PATENT DOCUMENTS 3,139,694 A * 7/1964 Schaefer ..... F41A 17/54 42/70.06
4,934,083 A * 6/1990 Smith ..... F41A 17/54 42/70.07
5,153,360 A * 10/1992 Upton ..... F41A 17/54 42/70.07
5,704,151 A 1/1998 West et al.
7,353,632 B2 4/2008 Newkirk et al.
9,448,025 B2 9/2016 Farr et al.
9,495,848 B2 11/2016 Crook
9,879,932 B2 1/2018 Milde et al.
10,048,032 B1 * 8/2018 Lazar ..... F41A 17/44
10,161,702 B2 12/2018 Xu
10,401,106 B1 * 9/2019 McMurray ..... F41A 17/06
10,612,877 B1 * 4/2020 Harris ..... F41A 17/02
2002/0116856 A1 * 8/2002 Troyer ..... F41A 17/04 42/70.11

(Continued)

FOREIGN PATENT DOCUMENTS

WO WO1995014901 A1 6/1995

*Primary Examiner* — Gabriel J. Klein

(57) ABSTRACT

A firearm security device blocks use or manipulation of functional components of a given firearm absent a validated user. The firearm security device includes a pair of hubs, a plurality of shackles, a trigger-locking shaft, a two-factor locking mechanism, a microcontroller, and a global position system (GPS) module. The pair of hubs along with the plurality of shackles allows the firearm security device to be secured to a firearm. The pair of hubs also protects the two-factor locking mechanism, the microcontroller, and the GPS module. The trigger-locking shaft prevents the trigger of a firearm from being pressed by an unwanted user. The two-factor locking mechanism prevents removal of the present invention from an associated firearm by an unwanted user. The microcontroller manages the two-factor locking mechanism and the GPS module. The GPS module allows the firearm security device to be tracked and, therefore, allows an associated firearm to be tracked.

13 Claims, 5 Drawing Sheets

(56) References Cited

U.S. PATENT DOCUMENTS

| | | | | |
|---|---|---|---|---|
| 2003/0066228 | A1* | 4/2003 | Smith | F41A 17/54 42/70.11 |
| 2003/0102273 | A1* | 6/2003 | McMurray | A47F 5/0861 211/5 |
| 2004/0011093 | A1* | 1/2004 | Fantl | F41A 17/44 70/38 A |
| 2007/0017137 | A1* | 1/2007 | Farchione | F41A 17/54 42/70.08 |
| 2008/0134556 | A1* | 6/2008 | Remelin | F41A 17/54 42/70.07 |
| 2015/0198402 | A1* | 7/2015 | Brace | F41A 17/54 42/70.06 |
| 2019/0376757 | A1* | 12/2019 | Myers | F41A 17/44 |

* cited by examiner

FIREARM SECURITY DEVICE

The current application claims a priority to the U.S. Provisional Patent application Ser. No. 62/833,466 filed on Apr. 12, 2019. The current application is filed on Apr. 13, 2020 while Apr. 12, 2020 was on a weekend.

FIELD OF THE INVENTION

The present invention relates generally to a remotely operable and multilayered, networked physical security device for firearms or similar implements. More specifically, the present invention is a firearm security device that blocks use or manipulation of functional components of a given firearm absent a validated user. Further, a means of continuous location tracking is contemplated, to be activated in the event of loss or theft of the present invention and an associated firearm.

BACKGROUND OF THE INVENTION

In present times, individuals are known to secure personal weapons with a variety of devices intended to prevent the unauthorized use or possession of said weapons. Aside from pragmatic concerns, this function has become a requirement in many jurisdictions wherein the security of a firearm is held to certain minimum standards before licensure of an individual is allowed. The combination of pragmatic and legal motivations has led to a multitude of market solutions for users wishing to maintain the security of their weapons without overly compromising their utility. For instance, it is understood that a firearm in a safe may be secure, but it is neither accessible nor useful in any meaningful way. Further solutions have involved the attachment of trigger-lockout or barrel-plug devices, but these solutions are limited by the inherent difficulties in creating a block for all trigger guards or a plug for all barrel calibers. Such bespoke devices are generally only suitable for one type or one family of related firearms sharing common dimensions or design features. It is therefore desirable to have a universal, flexible, adjustable, smart means of maintaining one's firearm.

The present invention aims to enable a user to effective lockout any unauthorized users from use or manipulation of a firearm via a firearm security device. It is further considered that the present invention will provide a means for users to track the real-time location and condition of the present invention and an associated firearm, including a means of operating digitized functions of the present invention remotely. Further features of the present invention are contemplated to include tamper-sensors, redundant physical access control systems, and a digital user profile employed to validate an authorized user and/or prove ownership of a weapon if recovered after a loss or theft.

DETAIL DESCRIPTIONS OF THE INVENTION

Figure 1:
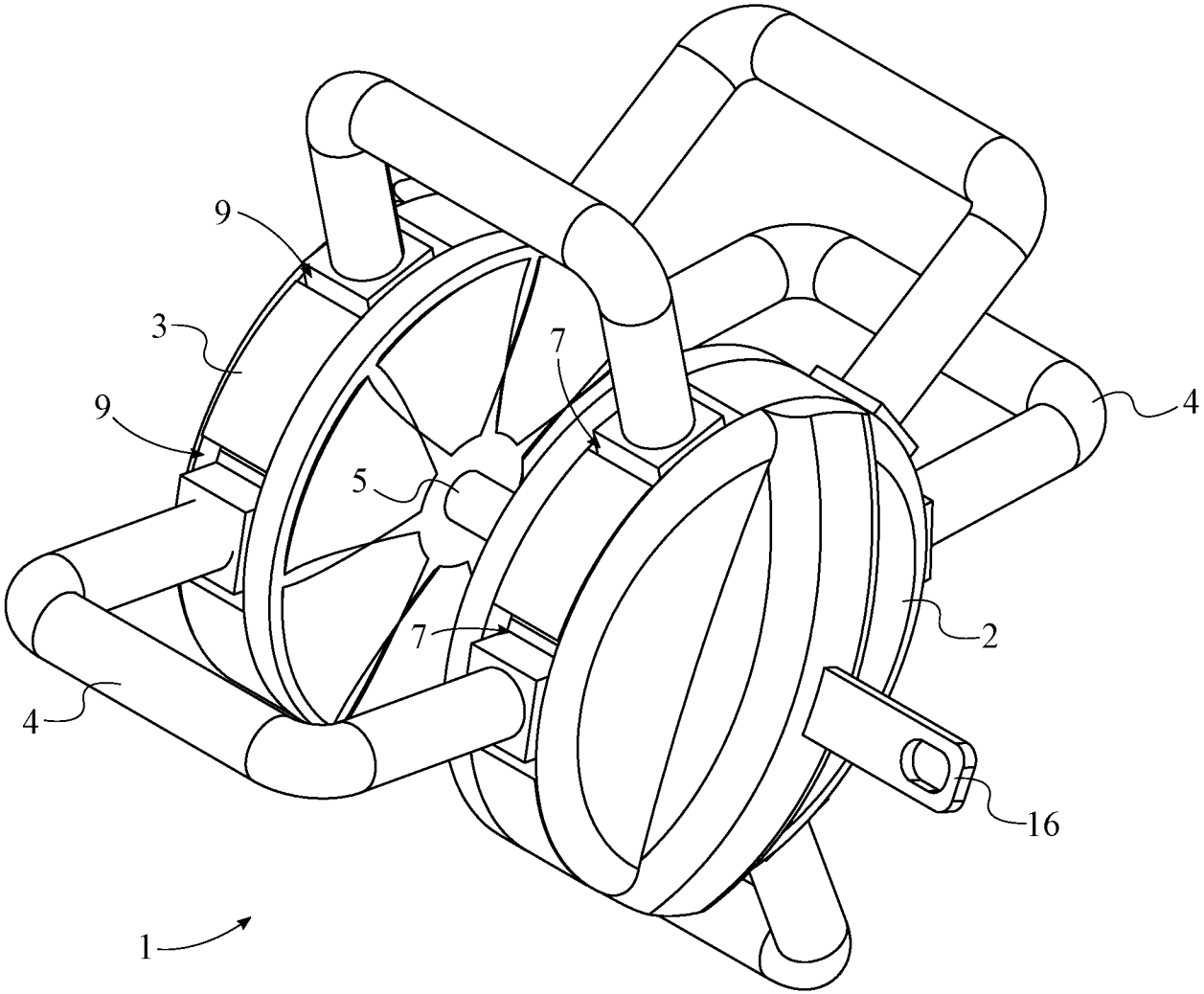
FIG. 1 is a front perspective view of the present invention.

All illustrations of the drawings are for the purpose of describing selected versions of the present invention and are not intended to limit the scope of the present invention.

In reference to FIGS. 1 through 5, the present invention is a firearm security device that blocks use or manipulation of functional components of a given firearm absent a validated user. Further, a means of continuous location tracking is contemplated, to be activated in the event of loss or theft of the present invention and an associated firearm. The firearm security device comprises a pair of hubs 1, a plurality of shackles 4, a trigger-locking shaft 5, a two-factor locking mechanism 6, a microcontroller 11, and a global position system (GPS) module 12. The pair of hubs 1 along with the plurality of shackles 4 allows the present invention to be secured to a firearm. The pair of hubs 1 also is used to house the two-factor locking mechanism 6, the microcontroller 11, and the GPS module 12. The trigger-locking shaft 5 prevents the trigger of a firearm from being pressed by an unwanted user. The two-factor locking mechanism 6 prevents removal of the present invention from an associated firearm by an unwanted user with two layers of security. The microcontroller 11 manages and controls the two-factor locking mechanism 6 and the GPS module 12. The GPS module 12 allows the present invention to be tracked and, therefore, allows an associated firearm to be tracked.

Figure 2:
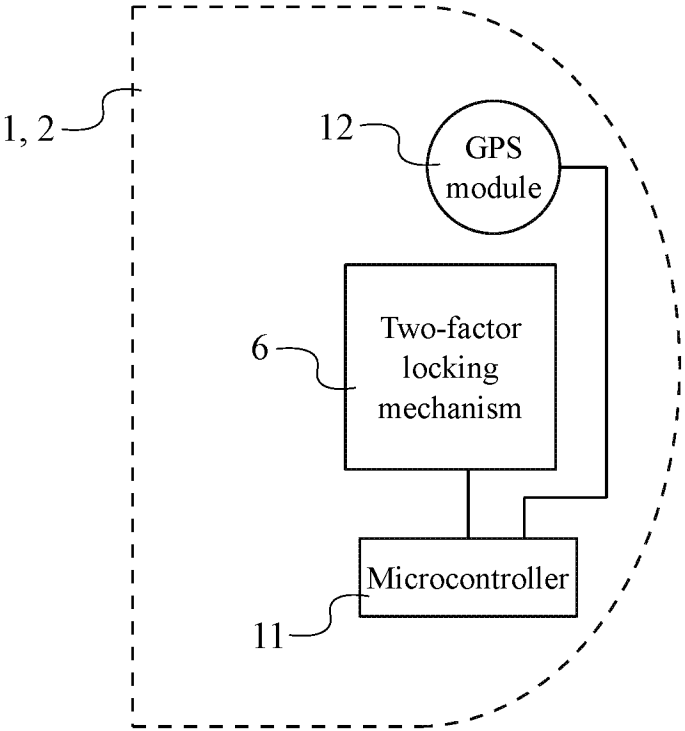
FIG. 2 is a schematic view illustrating the overall electronic connections of the present invention.
Figure 3:
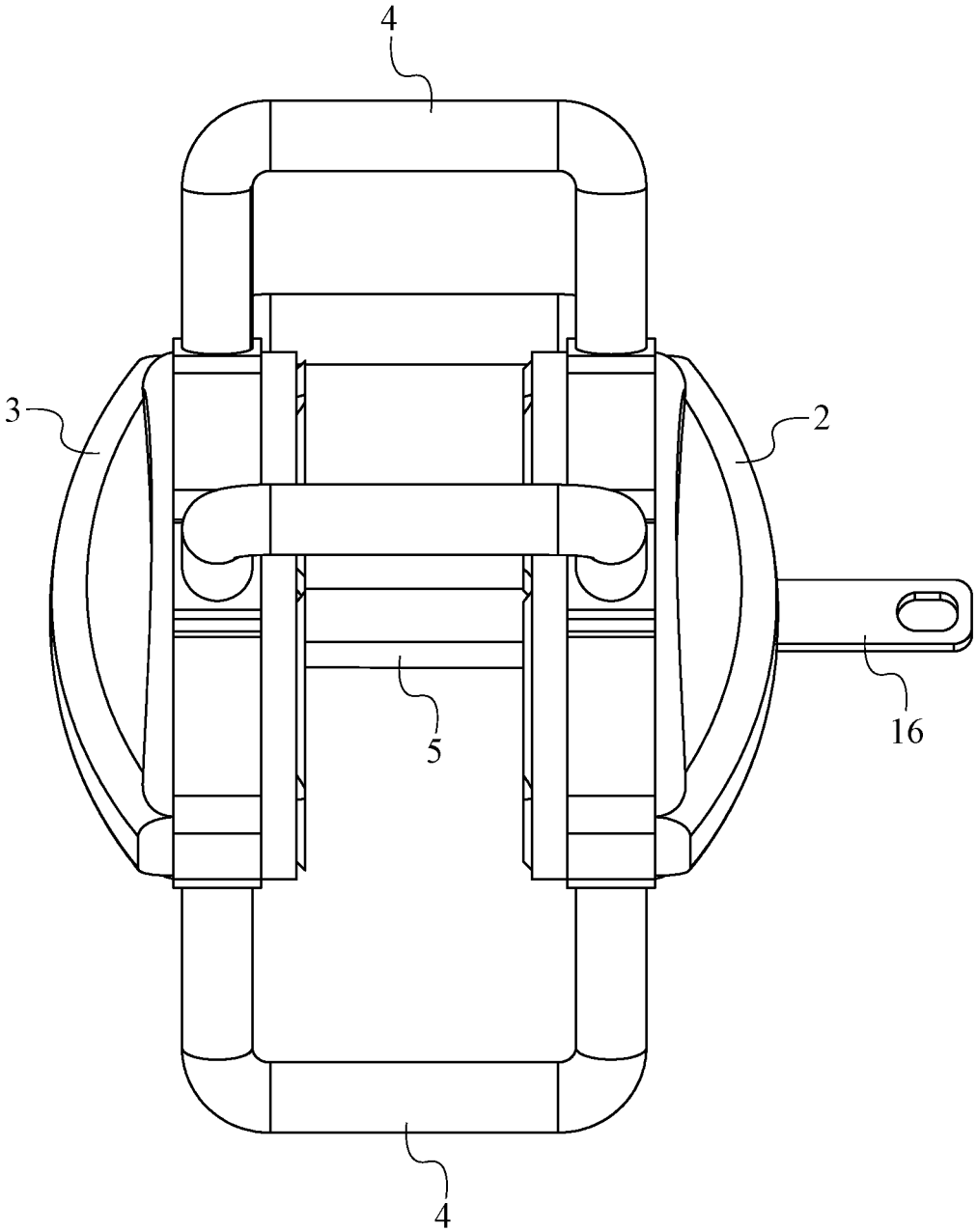
FIG. 3 is a front view of the present invention.
Figure 4:
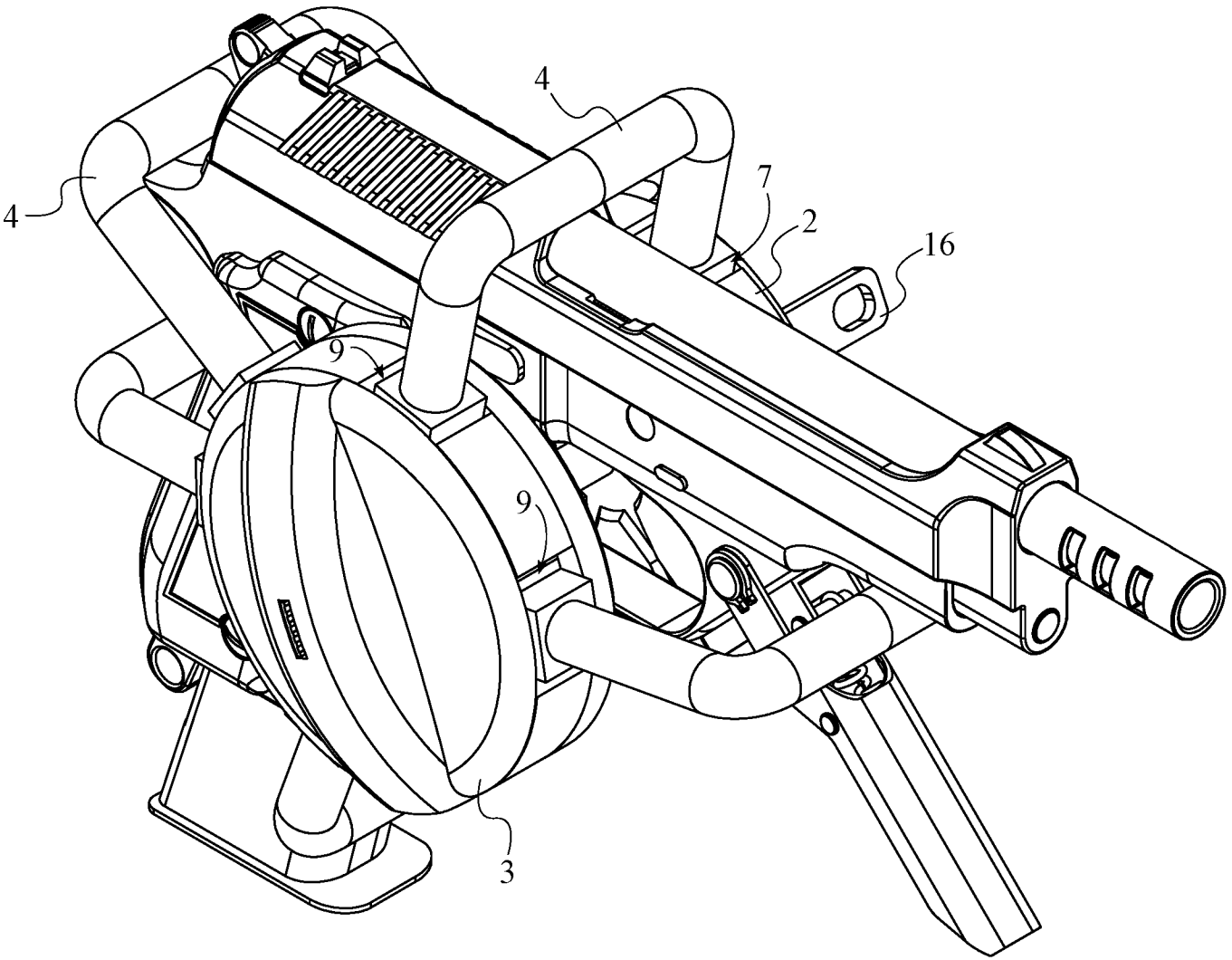
FIG. 4 is a front perspective view of the present invention engaged to a firearm.

The general configuration of the aforementioned components allows the present invention to block user or manipulation of functional components of a given firearm absent a validated user and provides a means of continuous location tracking, to be active in the event of loss or theft of the present invention and an associated firearm. With reference to FIGS. 1 and 2, the pair of hubs 1 is attached parallel and offset from each other by the trigger-locking shaft 5. With reference to FIG. 4, this arrangement allows the pair of hubs 1 to be at each side of a firearm while the trigger-locking shaft 5 is positioned behind the trigger of a firearm. Each of the plurality of shackles 4 is laterally and slidably attached in between the pair of hubs 1. This arrangement allows the pair of hubs 1 to be secured to a firearm by the plurality of shackles 4. Further, the plurality of shackles 4 can be slid into the pair of hubs 1 in order to fully secure the present invention onto a firearm and can be slid out of the pair of hubs 1 in order to remove the present invention from a firearm. Each of the plurality of shackles 4 is distributed around the trigger-locking shaft 5 in order for the plurality of shackles 4 to contact different parts of firearm, thereby, fully securing the present invention to a firearm. With reference to FIG. 3, the two-factor locking mechanism 6 is operatively integrated into the pair of hubs 1 and the trigger-locking shaft 5 so that the two-factor locking mechanism 6 is used to selectively secure each of the plurality of shackles 4 and the trigger-locking shaft 5 in place with the pair of hubs 1. Thus, the two-factor locking mechanism 6 prevents an unwanted user from removing the present invention from an associated firearm and, therefore, operating the associated firearm. The microcontroller 11 and the GPS module 12 are mounted within the pair of hubs 1 in order to be protected and concealed by the pair of hubs 1. Moreover, the GPS module 12 and the two-factor locking mechanism 6 are electronically connected to the microcontroller 11 in order to allow the microcontroller 11 to manage and control the GPS module 12 and two-factor locking mechanism 6. Thus, the GPS module 12 can be activated to ping the physical location of the present invention by the microcontroller 11, and the two-factor locking mechanism 6 can be locked or unlocked by the microcontroller 11.

Figure 5:
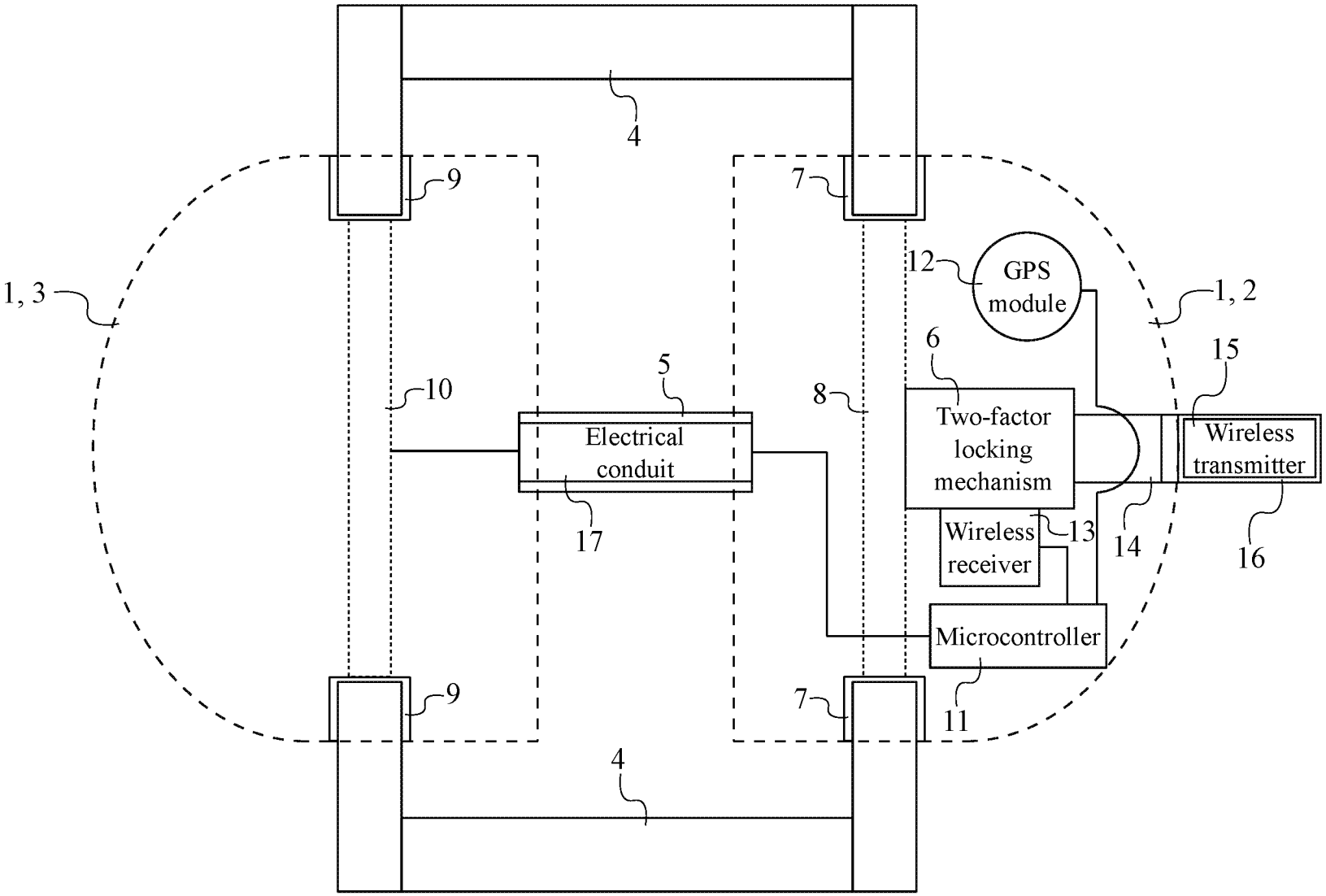
FIG. 5 is a schematic view further illustrating the electronic connections of the present invention.

In order for the present invention to wirelessly communication with an external device and with reference to FIG. 5, the present invention may further comprise a wireless receiver 13 and a tumbler 14. The wireless receiver 13 is preferably a personal area network (PAN) receiver (e.g. Bluetooth). The tumbler 14 is a locking mechanism that requires a key to lock or unlock. The wireless receiver 13 is mounted within the pair of hubs 1 and is electronically connected to the microcontroller 11. This arrangement allows the wireless receiver 13 to be protected and concealed by the pair of hubs 1 and to be managed and controlled by the microcontroller 11. Further, the wireless receiver 13 is operatively coupled to the two-factor locking mechanism 6 through the microcontroller 11, which allows the wireless receiver 13 to be used as one factor to lock or unlock the two-factor locking mechanism 6. In further detail, an external device can communicate with the microcontroller 11 through the wireless receiver 13 in order to lock or unlock one factor of the two-factor locking mechanism 6. An external device can be any device that includes a PAN transmitter such as, but not limited to, a smartphone or a personal computer. The tumbler 14 is integrated into the pair of hubs 1. This arrangement allows the tumbler 14 to be actuated through a key slot that traverses the pair of hubs 1. The tumbler 14 is operatively coupled to the two-factor locking mechanism 6, which allows the tumbler 14 to be used as another factor to lock or unlock the two-factor locking mechanism 6. In further detail, a key can be used to actuate the tumbler 14 to lock or unlock one factor of the two-factor locking mechanism 6.

In order for a user to unlock or lock both factors of the two-factor locking mechanism and with reference to FIGS. 1 and 5, the present invention may further comprise a wireless transmitter 15 and a physical key 16. The wireless transmitter 15 can communicate with the present invention through the wireless receiver 13. The wireless transmitter 15 is preferably a PAN transmitter. The physical key 16 can be used to actuate the tumbler 14. Further, the wireless transmitter 15 is mounted within the physical key 16. Thus, the wireless transmitter 15 is protected and concealed by the physical key 16 so that a user can lock or unlock the present invention with a single handheld unit. The tumbler 14 can be engaged by the physical key 16 in order to be locked or unlocked, while the wireless transmitter 15 is communicably coupled to the wireless receiver 13, which allows the physical key 16 to lock or unlock both factors of the two-factor locking mechanism 6.

In order for the plurality of shackles 4 to be securely retained around a firearm and with reference to FIGS. 4 and 5, the pair of hubs 1 may comprise a first hub 2, and the two-factor locking mechanism 6 may comprise a plurality of first shutters 7. The plurality of first shutters 7 is used to keep the plurality of shackles 4 in place, therefore, preventing removal of the present invention from a firearm. The plurality of first shutters 7 is laterally mounted into the first hub 2 and is distributed around the first hub 2. Thus, the plurality of first shutters 7 is effectively positioned to keep each shackle from the plurality of shackles 4 in place within the first hub 2. Further, each of the plurality of shackles 4 can be engaged by a corresponding shutter from the plurality of first shutters 7. Thus, the plurality of first shutters 7 can clamp onto the plurality of shackles 4 in order to prevent the plurality of shackles 4 from sliding out of the first hub 2 or can release the plurality of plurality of shackles 4 in order for the present invention to be removed from a firearm.

In order for the plurality of first shutters 7 to be automatically operated and with reference to FIG. 5, the two-factor locking mechanism 6 may further comprise a first shutter actuator 8. The first shutter actuator 8 is used to open or close the plurality of first shutters 7 in order to either release or retain the plurality of shackles 4 from or within the first hub 2. The first shutter actuator 8 is mounted within the first hub 2 and is electronically connected to the microcontroller 11. This arrangement protects and conceals the first shutter actuator 8 and allows the microcontroller 11 to manage and control the first shutter actuator 8. Further, the first shutter actuator 8 is operatively coupled to the plurality of first shutters so that the first shutter actuator 8 can open or close the plurality of first shutters 7. Thus, the plurality of shackles 4 can be released from the first hub 2 when the plurality of first shutters 7 is opened by the first shutter actuator 8, and the plurality of shackles 4 can be retained within the first hub 2 when the plurality of first shutters 7 is closed by the first shutter actuator 8.

Similarly and with reference to FIGS. 4 and 5, the pair of hubs 1 may comprise a second hub 3, and the two-factor locking mechanism 6 comprises a plurality of second shutters 9. The plurality of second shutters 9 is used to keep the plurality of shackles 4 in place, therefore, preventing removal of the present invention from a firearm. The plurality of second shutters 9 is laterally mounted into the second hub 3 and is distributed around the second hub 3. Thus, the plurality of second shutters 9 is effectively positioned to keep each shackle from the plurality of shackles 4 in place within the second hub 3. Further, each of the plurality of shackles 4 can be engaged by a corresponding shutter from the plurality of second shutters 9. Thus, the plurality of second shutters 9 can clamp onto the plurality of shackles 4 in order to prevent the plurality of shackles 4 from sliding out of the second hub 3 or can release the plurality of plurality of shackles 4 in order for the present invention to be removed from a firearm.

In order for the plurality of second shutters 9 to be automatically operated and with reference to FIG. 5, the two-factor locking mechanism 6 may further comprise a second shutter actuator 10. The second shutter actuator 10 is used to open or close the plurality of second shutters 9 in order to either release or retain the plurality of shackles 4 from or within the second hub 3. The second shutter actuator 10 is mounted within the second hub 3 and is electronically connected to the microcontroller 11. This arrangement protects and conceals the second shutter actuator 10 and allows the microcontroller 11 to manage and control the second shutter actuator 10. Further, the second shutter actuator 10 is operatively coupled to the plurality of second shutters 9 so that the second shutter actuator 10 can open or close the plurality of second shutters 9. Thus, the plurality of shackles 4 can be released from the second hub 3 when the plurality of second shutters 9 is opened by the second shutter actuator 10 or the plurality of shackles 4 can be retained within the second hub 3 when the plurality of second shutters 9 is closed by the second shutter actuator 10.

In order for the internal components of the first hub 2 to be in electronic communication with the internal components of the second hub 3 and with reference to FIG. 5, the present invention may further comprise an electronic conduit 17. The microcontroller 11, the first shutter actuator 8, and the second shutter actuator 10 are electrically connected to each other along the electronic conduit 17. Thus, the first shutter actuator 8 and the second shutter actuator 10 can respectively and synchronously open or close the plurality of first shutters 7 and the plurality of second shutters 9. The electronic conduit 17 is integrated into the trigger-locking shaft 5. Thus, the electronic connection between the microcontroller 11, the first shutter actuator 8, and the second shutter actuator 10 is established when the first hub 2 is attached to the second hub 3 by the trigger-locking shaft 5.

Although the invention has been explained in relation to its preferred embodiment, it is to be understood that many other possible modifications and variations can be made without departing from the spirit and scope of the invention as hereinafter claimed.

What is claimed is:

1. A firearm security device comprises:
a pair of hubs;
a plurality of shackles;
a trigger-locking shaft;
a two-factor locking mechanism;
a microcontroller;
a global positioning system (GPS) module;
the pair of hubs being attached parallel and offset from each other by the trigger-locking shaft;
each of the plurality of shackles being laterally and slidably attached in between the pair of hubs;
each of the plurality of shackles being distributed around the trigger-locking shaft;
the two-factor locking mechanism being operatively integrated into the pair of hubs and the trigger-locking shaft, wherein the two-factor locking mechanism is used to selectively secure each of the plurality of shackles and the trigger-locking shaft in place with the pair of hubs;
the microcontroller and the GPS module being mounted within the pair of hubs; and
the GPS module and the two-factor locking mechanism being electronically connected to the microcontroller.

2. The firearm security device as claimed in claim 1 comprises:
a wireless receiver;
a tumbler;
the wireless receiver being mounted within the pair of hubs;
the wireless receiver being electronically connected to the microcontroller;
the wireless receiver being operatively coupled to the two-factor locking mechanism through the microcontroller, wherein the wireless receiver is used as one factor to lock or unlock the two-factor locking mechanism
the tumbler being integrated into the pair of hubs; and
the tumbler being operatively coupled to the two-factor locking mechanism, wherein the tumbler is used as another factor to lock or unlock the two-factor locking mechanism.

3. The firearm security device as claimed in claim 2 comprises:
a wireless transmitter;
a physical key;
the wireless transmitter being mounted within the physical key;
the tumbler being engaged by the physical key; and
the wireless transmitter being communicably coupled to the wireless receiver.

4. The firearm security device as claimed in claim 1 comprises:
the pair of hubs comprises a first hub;
the two-factor locking mechanism comprises a plurality of first shutters;
the plurality of first shutters being laterally mounted into the first hub;
the first plurality of shutters being distributed around the first hub; and
each of the plurality of shackles being engaged by a corresponding shutter from the plurality of first shutters.

5. The firearm security device as claimed in claim 4 comprises:
the two-factor locking mechanism further comprises a first shutter actuator;
the first shutter actuator being mounted within the first hub;
the first shutter actuator being electronically connected to the microcontroller; and
the first shutter actuator being operatively coupled to the plurality of first shutters, wherein the first shutter actuator is used to open or close the plurality of first shutters.

6. The firearm security device as claimed in claim 1 comprises:
the pair of hubs comprises a second hub;
the locking mechanism comprises a plurality of second shutters;
the plurality of second shutters being laterally mounted into the second hub;
the second plurality of shutters being distributed around the second hub; and
each of the plurality of shackles being engaged by a corresponding shutter from the plurality of second shutters.

7. The firearm security device as claimed in claim 6 comprises:
the locking mechanism further comprises a second shutter actuator;
the second shutter actuator being mounted within the second hub;
the second shutter actuator being electronically connected to the microcontroller; and
the second shutter actuator being operatively coupled to the plurality of second shutters, wherein the second shutter actuator is used to open or close the plurality of second shutters.

8. The firearm security device as claimed in claim 1 comprises:
an electronic conduit;
the pair of hubs comprises a first hub and a second hub;
the two-factor locking mechanism comprises a first shutter actuator and a second shutter actuator;
the first shutter actuator being mounted within the first hub;
the second shutter actuator being mounted within the second hub;
the microcontroller, the first shutter actuator, and the second shutter actuator being electronically connected to each other along the electronic conduit; and
the electronic conduit being integrated into the trigger-locking shaft.

9. A firearm security device comprises:
a pair of hubs;
a plurality of shackles;
a trigger-locking shaft;
a two-factor locking mechanism;
a microcontroller;
a global positioning system (GPS) module;
a wireless receiver;
a tumbler;
the pair of hubs comprises a first hub and a second hub;
the two-factor locking mechanism comprises a plurality of first shutters and a plurality of second shutters;

the pair of hubs being attached parallel and offset from each other by the trigger-locking shaft;

each of the plurality of shackles being laterally and slidably attached in between the pair of hubs;

each of the plurality of shackles being distributed around the trigger-locking shaft;

the two-factor locking mechanism being operatively integrated into the pair of hubs and the trigger-locking shaft, wherein the two-factor locking mechanism is used to selectively secure each of the plurality of shackles and the trigger-locking shaft in place with the pair of hubs;

the microcontroller and the GPS module being mounted within the pair of hubs;

the GPS module and the two-factor locking mechanism being electronically connected to the microcontroller;

the wireless receiver being mounted within the pair of hubs;

the wireless receiver being electronically connected to the microcontroller;

the wireless receiver being operatively coupled to the two-factor locking mechanism through the microcontroller, wherein the wireless receiver is used as one factor to lock or unlock the two-factor locking mechanism the tumbler being integrated into the pair of hubs;

the tumbler being operatively coupled to the two-factor locking mechanism, wherein the tumbler is used as another factor to lock or unlock the two-factor locking mechanism;

the plurality of first shutters being laterally mounted into the first hub;

the first plurality of shutters being distributed around the first hub;

each of the plurality of shackles being engaged by a corresponding shutter from the plurality of first shutters;

the plurality of second shutters being laterally mounted into the second hub;

the second plurality of shutters being distributed around the second hub; and each of the plurality of shackles being engaged by a corresponding shutter from the plurality of second shutters.

10. The firearm security device as claimed in claim 9 comprises:

a wireless transmitter;

a physical key;

the wireless transmitter being mounted within the physical key;

the tumbler being engaged by the physical key; and the wireless transmitter being communicably coupled to the wireless receiver.

11. The firearm security device as claimed in claim 9 comprises:

the two-factor locking mechanism further comprises a first shutter actuator;

the first shutter actuator being mounted within the first hub;

the first shutter actuator being electronically connected to the microcontroller; and the first shutter actuator being operatively coupled to the plurality of first shutters, wherein the first shutter actuator is used to open or close the plurality of first shutters.

12. The firearm security device as claimed in claim 9 comprises:

the locking mechanism further comprises a second shutter actuator;

the second shutter actuator being mounted within the second hub;

the second shutter actuator being electronically connected to the microcontroller; and the second shutter actuator being operatively coupled to the plurality of second shutters, wherein the second shutter actuator is used to open or close the plurality of second shutters.

13. The firearm security device as claimed in claim 9 comprises:

an electronic conduit;

the pair of hubs comprises a first hub and a second hub;

the two-factor locking mechanism comprises a first shutter actuator and a second shutter actuator;

the first shutter actuator being mounted within the first hub;

the second shutter actuator being mounted within the second hub;

the microcontroller, the first shutter actuator, and the second shutter actuator being electronically connected to each other along the electronic conduit; and the electronic conduit being integrated into the trigger-locking shaft.

* * * * *